US005924314A

United States Patent [19]

Cernansky

[11] Patent Number: 5,924,314

[45] Date of Patent: Jul. 20, 1999

[54] PADLOCK PROTECTING LOCKING BAR

[76] Inventor: Paul Cernansky, 55 Fairway Dr., Miami, Fla. 33166

[21] Appl. No.: 09/163,834

[22] Filed: Sep. 30, 1998

Related U.S. Application Data

[60] Provisional application No. 60/060,519, Sep. 30, 1997.

[51] Int. Cl.[6] ..... E05B 67/38

[52] U.S. Cl. ..... 70/56; 70/54; 70/232

[58] Field of Search ..... 70/54–56, 417, 70/232, 158–164

[56] References Cited

U.S. PATENT DOCUMENTS

| | | | |
|---|---|---|---|
| 2,703,501 | 3/1955 | Wooldridge | 70/232 |
| 3,287,943 | 11/1966 | Vaughn et al. | 70/232 |
| 3,650,130 | 3/1972 | Thompson | 70/232 X |
| 3,769,821 | 11/1973 | Randel | 70/56 X |
| 3,943,738 | 3/1976 | Foote | 70/54 X |
| 4,068,505 | 1/1978 | Volk, Jr. | 70/56 |
| 4,294,088 | 10/1981 | Barr | 70/232 X |
| 4,350,032 | 9/1982 | Kochackis | 70/427 |
| 4,777,809 | 10/1988 | Wiggins | 70/232 X |
| 4,896,518 | 1/1990 | Appelgren | 70/54 |
| 4,905,486 | 3/1990 | Appelbaum | 70/54 |
| 5,307,653 | 5/1994 | Davis | 70/56 |
| 5,309,742 | 5/1994 | Lawrence | 70/232 |
| 5,322,316 | 6/1994 | Wheeler | 70/232 X |
| 5,433,093 | 7/1995 | Sooth | 70/56 |
| 5,737,946 | 4/1998 | Sole et al. | 70/54 |
| 5,743,118 | 4/1998 | Anderson | 70/56 |

*Primary Examiner*—Suzanne Dino Barrett
*Attorney, Agent, or Firm*—Lott & Friedland, P.A.

[57] ABSTRACT

A padlock protecting locking apparatus for protection against hacksaws, bolt cutters and the like is disclosed comprising an elongated tube slideably received by a slidebolt latch via an access channel in the tube. An aperture located substantially in the center of the tube provides access to the slidebolt latch. A bridge element spans the aperture and permits the shackle of a padlock to encircle the slidebolt latch and the bridge element, thereby locking the apparatus to the slidebolt latch.

6 Claims, 2 Drawing Sheets

PADLOCK PROTECTING LOCKING BAR

RELATED APPLICATIONS

This application claims the benefit of U.S. Provisional Application No. 60/060,519, filed Sep. 30, 1997.

TECHNICAL FIELD

This invention is directed to an assembly for protecting padlocks and other locking devices from bolt cutters, hacksaws and similar instruments. More specifically, this invention integrates with slidebolt latches commonly utilized in cargo trailers and self-storage facilities to providing shielding from attack, yet easy access for locking and unlocking the apparatus.

BACKGROUND OF THE INVENTION

Many vehicle cargo containers as well as public storage facilities are equipped with a sliding-bolt type of door latch and locking mechanism. A drawback associated with this type of latching and locking mechanism is that it can be easily defeated by the use of bolt cutters, hacksaws and the like. Such instruments require access and leverage to the latch or lock to operate effectively. A common solution to this problem is to provide a latching and locking assembly that physically impedes access to the latch or lock itself.

Previous attempts have been made to restrict access and leverage to locking structures such as described in U.S. Pat. No. 5,743,118 to Anderson ('118 patent); U.S. Pat. No. 5,307,653 to Davis ('653 patent); U.S. Pat. No. 4,896,518 to Appelgren ('518 patent); all of which are incorporate herein by reference.

The '118 patent to Anderson describes a lock guard for a tractor trailer door latch system comprising a main housing unit fashioned to cover a door latch system and a cut-out aperture in the housing unit dimensioned to receive a padlock. The housing unit is slid over the door handle and a padlock is secured within the housing, fastening the latch system to the housing unit. The housing unit effectively shields the padlock and its shackle from tampering on four of the five sides of the housing. However, the housing requires the user to lock the padlock into place by inserting it through the side of the apparatus. Additionally, the side-access to the padlock can make unlocking the apparatus difficult.

The '653 patent to Davis describes a padlock security device which shields only the shackle of the padlock. Therefore, the body of the padlock is exposed to hammering, prying or the like. The '653 patent does not protect a slidebolt-type of latch.

The '518 patent to Appelgren describes a protective metal plate and housing to shield a padlock. However, the '518 patent does not enclose and shield both the padlock and the latch from attack nor does it function to protect a slidebolt latch.

Consequently, there is a need in the art for a padlock protecting device that enables easy access for locking and unlocking the padlock as well as protecting the body of the padlock from hammering or prying. In addition, there is a need for a shielding device to protect the slidebolt latch and cooperating padlock from defeat.

SUMMARY OF THE INVENTION

The present invention solves significant problems in the art by providing a shielding enclosure for a slidebolt latch and the padlock which secures the latch. In a preferred embodiment of the invention, an elongated tube is provided having a generally square cross-sectional area. The tube is preferably constructed of a hard, non-corrosive metal. An access channel extends substantially the length of the tube and is sized to slideably enclose the slidebolt latch. Notches may be formed within the access channel to receive protrusions on the slidebolt latch and permit assembly of the padlock protecting locking bar to the slidebolt latch. An aperture in substantially the center of the tube provides access to the slidebolt latch. The aperture is spanned by a hardened bridge element. The shackle of a padlock encircles both the slidebolt latch and the bridge element, thereby securing the entire assembly. The padlock is easily accessible for locking and unlocking, yet both the padlock and the slidebolt are protected from assault by cutting, sawing and prying.

DETAILED DESCRIPTION OF THE PREFERRED EMBODIMENT

Figure 1:
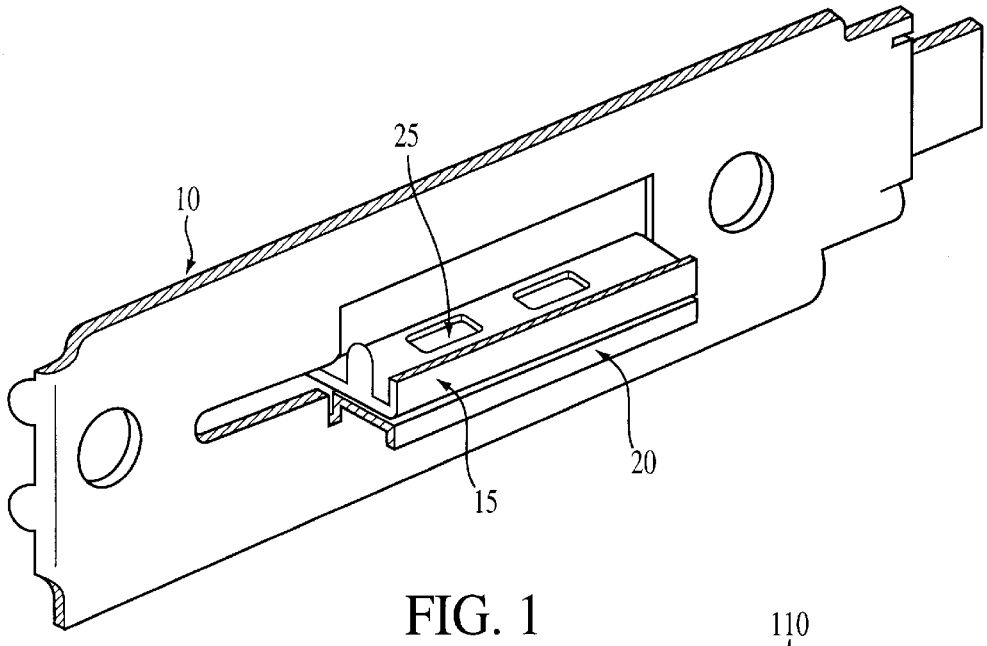
FIG. 1 is a perspective view of a typical slidebolt latch known in the art.

Referring initially to FIG. 1 and of the drawings, in which like numerals indicate like elements throughout the several views, a typical slidebolt latch 10 is illustrated, comprising a slideable upper flange 15 and a fixed lower flange 20. The upper flange 15 and the lower flange 20 have similarly shaped openings 25 to accept a locking device. When the slidebolt latch is in a locked position, the openings 25 in the upper flange 15 and lower flange 20 substantially align.

Figure 2:
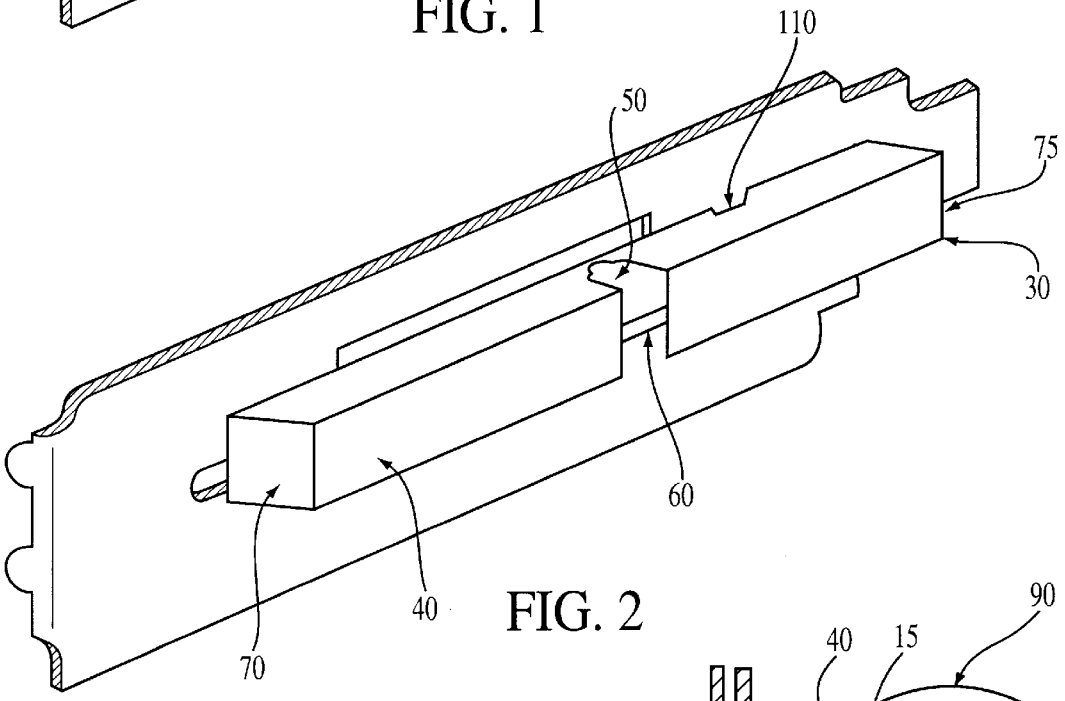
FIG. 2 is a perspective view of a preferred embodiment of the padlock protecting locking assembly according to the invention attached to the slidebolt latch.
Figure 3:
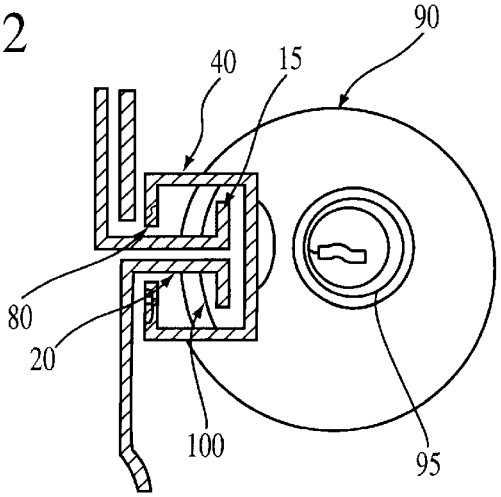
FIG. 3 is an enlarged end sectional view of a preferred embodiment of the padlock protecting locking assembly according to the invention.
Figure 4:
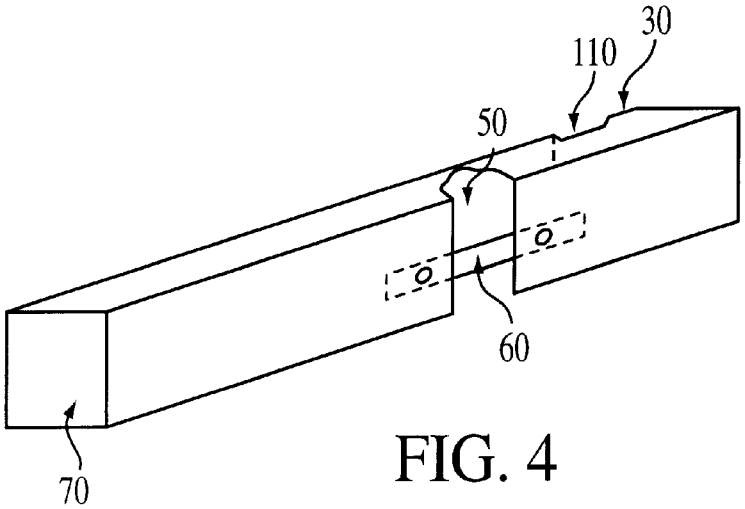
FIG. 4 is a perspective view of a preferred embodiment of the padlock protecting locking assembly according to the invention.
Figure 5:
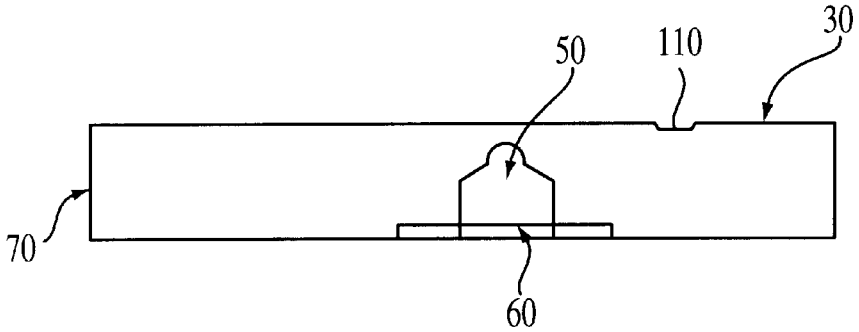
FIG. 5 is a top view of a preferred embodiment of the padlock protecting locking assembly.
Figure 6:
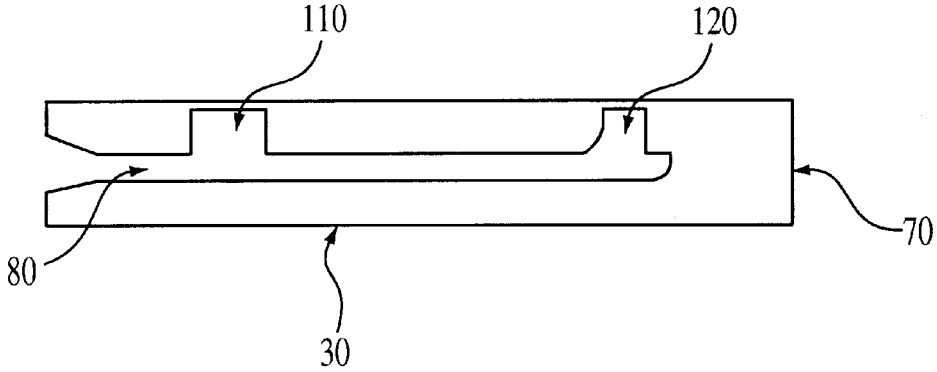
FIG. 6 is a cross sectional rear view of the padlock protecting locking assembly according to the invention.

FIG. 2 shows a padlock protecting locking bar 30 installed on the slidebolt latch, comprising an elongated tube 40, a closed end 70 of the tube, an open end 75 of the tube, an aperture 50 substantially located in the center of the tube, and a bridge element 60 spanning the aperture. As shown in FIG. 3 and FIG. 6 an access channel 80 extends from the open end 75 to the closed end 70 of the tube 40. The access channel 80 is sized to slideably enclose the upper flange 15 and lower flange 20 of the slidebolt latch 10. FIG. 3 shows a padlock 90 with a shackle 100 engaged to the slidebolt latch 10 and the padlock protecting locking bar 30. The shackle 100 is inserted through the openings 25 in the upper flange 15 and lower flange 20 of the slidebolt latch 10. The shackle 100 also encircles the bridge element 60, thereby locking the padlock protecting locking bar 30 to the slidebolt latch 10. As illustrated in FIGS. 4–6, notches 110 and 120 may be formed to integrate with protrusions in the slidebolt latch 10.

Although no particular material of construction is required, a preferred embodiment of the invention would utilize stainless steel for strength and to prevent oxidation which can weaken structural integrity. If stainless steel is not used, the surfaces should be covered with an industrial coating, such as epoxy or sealant. It is preferable that the bridge element 60 be formed of a ½ inch wide by ⅛ inch think metal strap. Preferably, a disc lock is used to secure the assembly, although a modified hitch lock or standard padlock may be used.

Accordingly, it will be understood that the preferred embodiment of the present invention has been disclosed by way of example and that other modifications and alterations may occur to those skilled in the art without departing from the scope and spirit of the appended claims.

What is claimed is:

1. A padlock protecting locking bar comprising:

(a) an elongated tube mountable to a slidebolt latch;

(b) an access channel extending substantially the length of the tube, sized to slideably enclose the slidebolt latch;

(c) an aperture in the tube providing access to the slidebolt latch, sized to accommodate a padlock having a shackle;

(d) a bridge element spanning the aperture and rigidly secured to the tube;

whereby the elongated tube is slideably received via the access channel over the slidebolt latch, the aperture in the tube exposing the slidebolt latch, the shackle of the padlock enveloping and securing both the slidebolt latch and the bridge element to each other.

2. The padlock protecting locking bar of claim 1 whereby the elongated tube has a substantially rectangular cross-section.

3. The padlock protecting locking bar of claim 1 whereby a plurality of notches within the access channel receive corresponding protrusions on the slidebolt latch.

4. The padlock protecting locking bar of claim 1 whereby the bridge element is formed of a ½ inch wide by ⅛ inch thick metal strap.

5. The padlock protecting locking bar of claim 1 whereby the tube and bridge element are constructed of stainless steel.

6. The padlock protecting locking bar of claim 1 whereby the tube and bridge element are covered with an oxidation-resistant sealant.

* * * * *